US006755587B2

(12) United States Patent
Fukushima

(10) Patent No.: US 6,755,587 B2
(45) Date of Patent: Jun. 29, 2004

(54) DIRECT-FEED BALLPOINT WRITING IMPLEMENT

(75) Inventor: Makoto Fukushima, Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 0 days.

(21) Appl. No.: 10/394,018

(22) Filed: Mar. 24, 2003

(65) Prior Publication Data

US 2004/0081506 A1 Apr. 29, 2004

(30) Foreign Application Priority Data

Apr. 4, 2002 (JP) ..... 2002-102144

(51) Int. Cl.[7] ..... B43K 7/10; B43K 5/00; B43K 5/02

(52) U.S. Cl. ..... 401/214; 401/216; 401/198; 401/224

(58) Field of Search ..... 401/198, 199, 401/209, 212, 214, 216, 223, 224–228

(56) References Cited

U.S. PATENT DOCUMENTS 6,220,774 B1 * 4/2001 Fukushima ..... 401/214
6,299,375 B1 * 10/2001 Abe ..... 401/214
6,435,747 B2 * 8/2002 Furukawa et al. ..... 401/34

* cited by examiner

*Primary Examiner*—David J. Walczak
(74) *Attorney, Agent, or Firm*—Rothwell, Figg, Ernst & Manbeck

(57) ABSTRACT

A direct-feed ballpoint writing implement includes a barrel internally provided with an ink tank, a grooved member placed in a front part of the barrel and provided with a groove for guiding air and ink, an ink feed member pressed in the grooved member, a barrel tip fixedly joined to a front end part of the grooved member, a ball holder inserted in the barrel tip and put on a front end part of the ink feed member, and a ball held in a front end part of the ball holder. A compression spring may be extended at least between the ink feed member and the ball in the ball holder.

3 Claims, 6 Drawing Sheets

DIRECT-FEED BALLPOINT WRITING IMPLEMENT

BACKGROUND OF THE INVENTION

1. Field of the Invention

The present invention relates to a direct-ink-feed ballpoint writing implement using a low-viscosity ink, such as a water-base ink.

2. Description of the Related Art

Conventional ballpoint writing implements using a low-viscosity ink are classified into those of an impregnated wick type and those of direct-feed type. The ballpoint writing implement of an impregnated wick type has a barrel packed with an ink-holding wick of fibers impregnated with ink, and an ink-feeder wick for carrying the ink to a ball held in the tip of the barrel. A direct-feed ballpoint writing implement, which is relevant to the present invention, has a barrel having an ink tank containing ink, and a ball held in the tip of the barrel. In the direct-feed ballpoint writing implement, the ink is fed from the ink tank to the ball at a regulated rate.

A direct-feed ballpoint writing implement shown in FIG. 1 includes a barrel 21, a grooved member 22 (core), an ink feed member 23, a barrel cap 24, a ball holder 25, and a ball 26. The ink feed member 23 is formed by bundling polyester fibers and is capable of carrying the ink to the ball 26. It is important to set the ink feed member 23 so that the front end of the ink feed member 23 is located as close as possible to the ball 26. If the front end of the ink feed member is excessively close to the ball 26, or is in contact with the ball 26, the ball 26 is pressed against a socket formed in the ball holder 25 and any clearance is not formed between the ball holder 25 and the ball 26. Consequently, the ink is unable to wet the ball 26, faint and scratchy lines are drawn and, in the worst case, the ballpoint pen is unable to draw any lines.

An ink feed mechanism capable of feeding the ink at a proper rate to the ball must be interposed between the ink contained in an ink tank and the ball. The ink feed mechanism must be capable of properly feeding the ink contained in the barrel to the ball, of letting air into the barrel according to the consumption of the ink and of preventing the flow of the ink at an excessive high rate to the ball due to the rise of the ambient temperature.

The ink is carried from the ink tank to the ball by capillarity. A quantity of air corresponding to that of the ink sucked by the ink feed member must be discharged from the ink feed member to make the capillarity of the ink feed member effective, and a quantity of air equal to that of the ink that flowed from the ink tank into the ink feed member must be sucked into the ink tank for smooth ink feed.

Since the material forming the ink feed member is comparatively soft, it is difficult to locate the ink feed member accurately in the barrel. The location of an ink feed member formed by molding a plastic material in the barrel is easier than that of the ink feed member formed by bundling the polyester fibers. However, the ink feed member formed by molding a plastic material is inferior to the ink feed member formed by bundling the polyester fibers in ink carrying capability and is unable to insure stable writing.

When the direct-feed ballpoint writing implement is held with the ball in contact with a sheet, the ink is transferred from the ball to the sheet and an ink spot is formed even if the ball does not roll. If the direct-feed ballpoint writing implement is used with its axis tilted greatly from the vertical, the tip of the barrel cap is always in frictional contact with the sheet and is abraded gradually and, eventually, the socket of the ball holder wears out and becomes unable to hold the ball, and the ball falls off.

SUMMARY OF THE INVENTION

Accordingly, it is an object of the present invention to provide a direct-feed ballpoint writing implement including a ball holder, a compression spring placed in the ball holder and having a back set end and an ink feed member connected to the back set end of the compression spring, and capable of ensuring uniform ink feed and stable writing.

Another object of the present invention is to provide a direct-feed ballpoint writing implement including an ink tank containing ink, a ball holder, a ball held in the ball holder and a spring pressing the ball toward the tip of the ball holder, and capable of preventing the leakage of the ink contained in the ink tank from its tip due to the sudden rise of the ambient temperature or the sudden pressure drop of the ambient pressure.

A third object of the present invention is to provide a direct-feed ballpoint writing implement including a barrel and a cap put on the barrel to prevent the evaporation of the ink, and capable of preventing the leakage of the ink due to the pumping effect (pressure reducing effect) of removing the cap from the barrel, and of preventing the suction of air due to the pumping effect (pressure increasing effect) of putting the cap on the barrel.

A fourth object of the present invention is to provide a direct-feed ballpoint writing implement including a ball, a ball holder holding the ball in a socket formed in its tip part, and a spring pressing the ball against the socket of the ball holder, and capable of preventing the falling of the ball off the ball holder due to the gradual wear of the tip of the barrel cap by frictional abrasion caused by the sheet and the eventual loss of ball-holding capability of the ball holder when the direct-feed ballpoint writing implement is used with its axis tilted greatly from the vertical.

According to one aspect of the present invention, a direct-feed ballpoint writing implement comprises a barrel internally provided with an ink tank, a grooved member placed in a front part of the barrel and provided with a groove for guiding air and ink, an ink feed member pressed in the grooved member, a barrel tip fixedly joined to a front end part of the grooved member, a ball holder inserted in the barrel tip and put on a front end part of the ink feed member; and a ball held in a front end part of the ball holder; wherein a compression spring is extended at least between the ink feed member and the ball in the ball holder.

DESCRIPTION OF THE PREFERRED EMBODIMENTS

Figure 1:
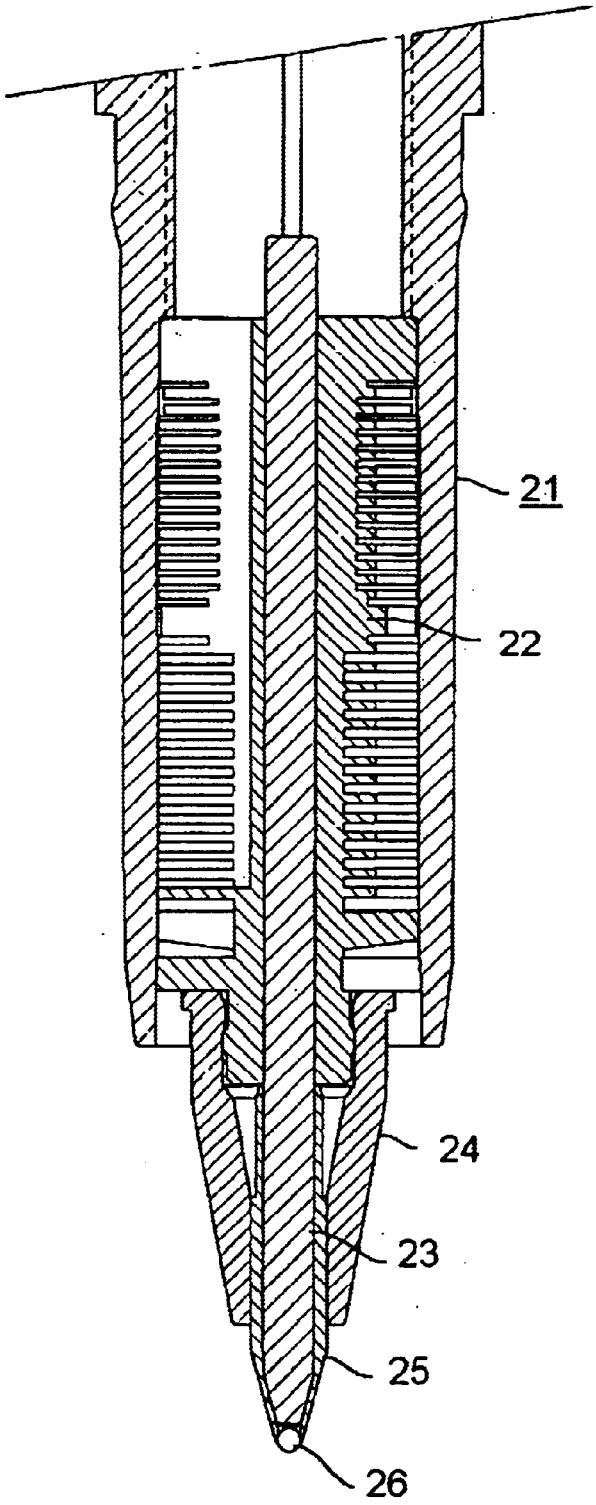
FIG. 1. (PRIOR ART)
FIG. 1 is a longitudinal sectional view of a conventional direct-feed ballpoint writing implement.
Figure 2:
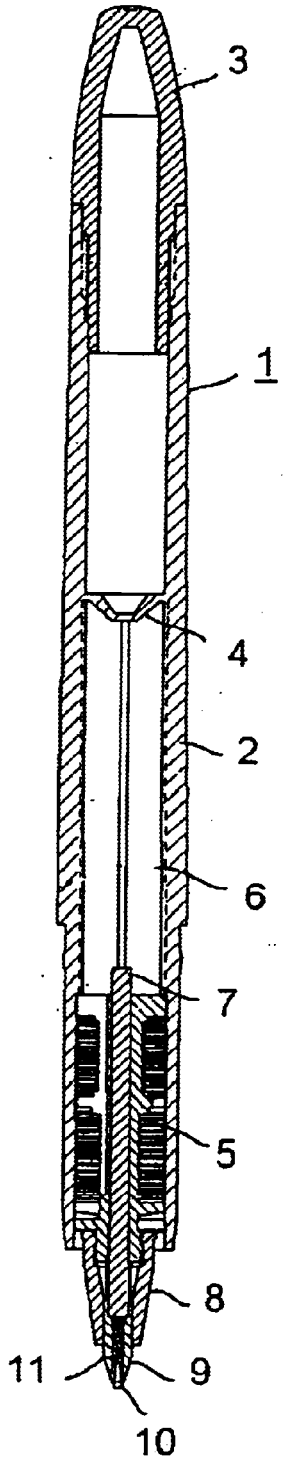
FIG. 2 is a longitudinal sectional view of a direct-feed ballpoint writing implement in a first embodiment according to the present invention.
Figure 3:
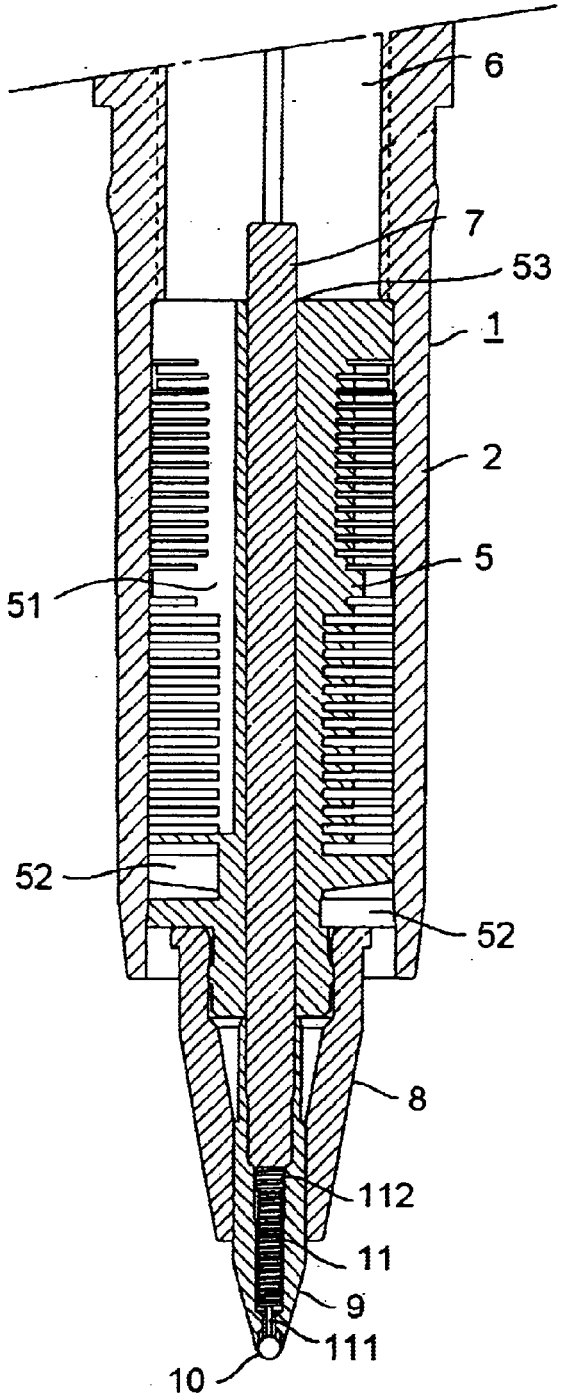
FIG. 3 is an enlarged, longitudinal sectional view of a front part of the direct-feed ballpoint writing implement shown in FIG. 2.
Figure 4:
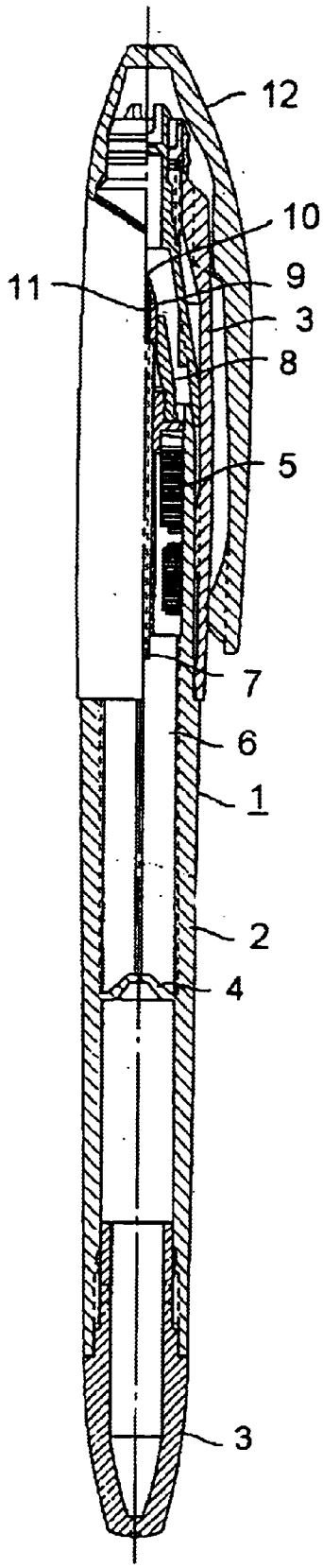
FIG. 4 is a longitudinal sectional view of the direct-feed ballpoint writing implement shown in FIG. 2 with a cap put on its front part.

FIG. 2 is a longitudinal sectional view of a direct-feed ballpoint writing implement in a first embodiment according to the present invention, FIG. 3 is an enlarged, longitudinal sectional view of an essential part of the direct-feed ballpoint writing implement shown in FIG. 2 and FIG. 4 is a longitudinal sectional view of the direct-feed ballpoint writing implement shown in FIG. 2 with a cap put on it front part.

As shown in FIGS. 2 to 4 a barrel 1 has a front barrel 2 and a back barrel 3 joined to the front barrel 2. The front barrel 2 is provided with a partition 4 in its bore. A grooved member 5 is fixedly fitted in a front part of the front barrel 2. An ink tank 6 is formed between the partition 4 and the grooved member 5, and is filled with a low-viscosity ink, such as a water-base ink. The grooved member 5 must be capable of feeding the ink to the tip of the direct-feed ballpoint writing implement by capillary, of sucking a quantity of air corresponding to that of the ink fed to the tip into the barrel 1, and of reserving the ink excessively delivered from the ink tank 6 to prevent the excessive feed of the ink to the tip. The grooved member 5 is provided with vent holes 52 in its front part, and an ink carrying groove 51, for carrying the ink and air, communicating with the vent holes 5. The grooved member 5 is provided with an axial ink feed bore 53. An ink feed member 7 is fitted in the ink feed bore 53. The ink flows from the ink tank 6 through a space between the grooved member 5 and the ink feed member 7 to the tip.

A tapered barrel cap 8 is fixedly put on a front part of the grooved member 5. A ball holder 9 is fitted in a front part of the barrel tip 8 and is put on a front part of the ink feed member 7. A ball is held for rolling in a front end part of the ball holder 9. A compression spring 11 is extended in a space between the front end of the ink feed member 7 and the ball 10 in the ball holder 9 to apply a fixed pressure to the ball 10 so that the ball 10 is pressed against the front end of the ball holder 9 and is partly protruded outside from the tip of the ball holder 9~ The spring 11 has a straight part 111 axially extending from its front end coil to apply the pressure properly axially to the ball 10. As shown in FIG. 4, a cap 12 is put detachably on the front barrel 2 of the barrel 1 to prevent the evaporation of the ink.

In assembling the direct-feed ballpoint writing implement, the ball is put in a socket formed in a front end part of the ball holder 9 and the front end part of the ball holder 9 is reduced by nosing to hold the ball 10 for rolling in the ball holder 9. The barrel 1 is held with its open front end facing up, and the ink tank 6 is filled with the ink. Then, the grooved member 5 is inserted in the front barrel 2. A tip unit is assembled by fitting the ball holder 9 in the barrel cap 8 and putting the ball holder 9 on the ink feed member 7. The tip unit pressed in the front barrel 2, and the cap 12 is put on the front barrel 2 to complete the direct-feed ballpoint writing implement.

In using the direct-feed ballpoint writing implement, the cap 12 is removed from the front barrel 2 to expose the ball holder 9 for writing. In this state, the ink contained in the ink tank 6 of the barrel 1 has been carried along the ink feed member 7 through the ink feed bore 53 of the grooved member 5 along the ink feed member 7 to the ball 10 held in the ball holder 9. When the ball 10 is applied to a paper sheet and moved on the surface of the paper sheet, the ink is transferred from the ball 10 to the paper sheet by the capillary and the rolling of the ball 10 to draw lines on the paper sheet. During such a writing operation, the compression spring 11 applies a proper pressure to the ball 10 such that a proper space is maintained between the ball 10 and the front end of the ink feed member 7. Thus, the ink is fed regularly at a proper rate to the ball 10 and satisfactory writing can be achieved. The axially extending straight part 111 of the compression spring 11 applies pressure effectively to the ball 10.

Figure 5:
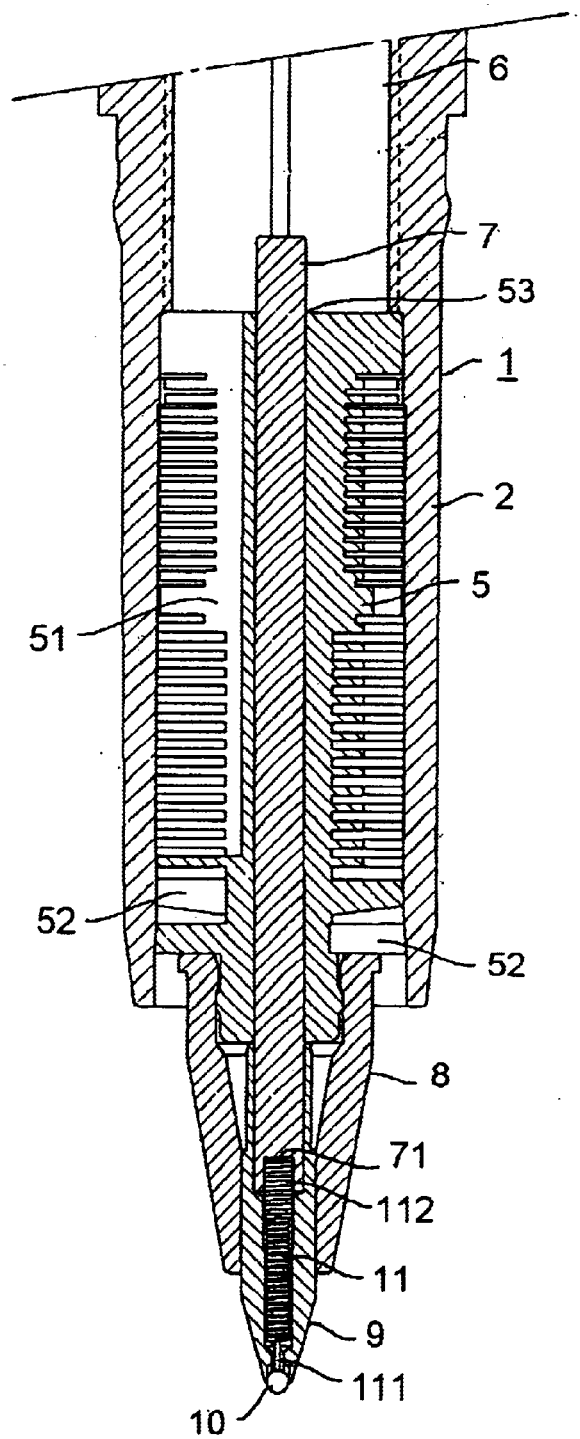
FIG. 5 is a longitudinal sectional view of a direct-feed ballpoint writing implement in a second embodiment according to the present invention.

As the ink contained in the ink tank 6 decreases, air held in the grooved member 5 and external air flows through the ink carrying groove 51 into the ink tank 6. Therefore, the pressure in the ink tank does not drop below the atmospheric pressure and the ink is fed through the ink feed bore 53 to the ball 10 by capillary. More specifically, a quantity of external air corresponding to that of the ink consumed by writing flows through the vent holes 52 formed in the front part of the grooved member 5 and the ink carrying groove 51 into the ink tank 6. Referring to FIG. 5 showing a direct-feed ballpoint writing implement in a second embodiment according to the present invention in a longitudinal sectional view, the direct-feed ballpoint writing implement is provided with a spring 11 having a squared back end 112, and an ink feed member 7 having a front end part provided with a recess 71. The squared back end 112 of the spring 11 is fitted in the recess 71 of the ink feed member 7. Thus, the spring 11 can be held stably and is able to exert an elastic force on a ball 10 to ensure stable, satisfactory writing.

Figure 6:
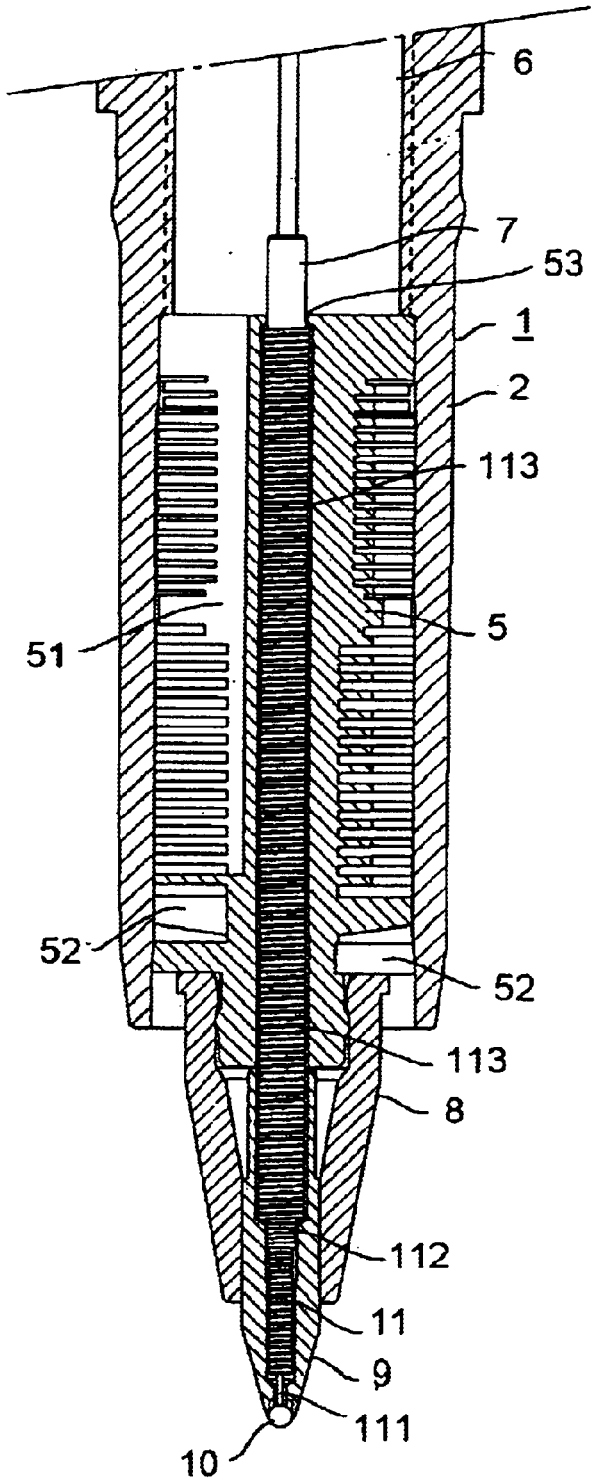
FIG. 6 is a longitudinal sectional view of a direct-feed ballpoint writing implement in a third embodiment according to the present invention.

Referring to FIG. 6 showing a direct-feed ballpoint writing implement in a third embodiment according to the present invention in a longitudinal sectional view, the direct-feed ballpoint writing implement is provided with a spring 11 having a back part 113 having a large diameter and surrounding an ink feed member 7. This spring 11 is deflected slightly, can be stably held and is able to exert an elastic force more stably on a ball 10.

The grooved member 5 may be of any suitable construction provided that the grooved member 5 is able to exercise the foregoing functions. For example, a grooved member disclosed in JP-A No. 106087/1991 having an air suction passage of complicated construction for guiding air into the ink tank including a vent hole, a space, a helical groove, an air groove, an ink groove, a side hole, a space, an ink groove connected to the ink tank may be incorporated in the present invention.

The compression spring placed in the ball holder and having the squared back end connected to the ink feed member enables regular ink feed and ensures stable writing.

While the direct-feed ballpoint writing implement is not in use, the leakage of the ink contained in the ink tank through the tip of the direct-feed writing implement due to the sudden rise of the ambient temperature or the sudden reduction of the ambient pressure can be prevented because the ball is pressed continuously against the inner surface of the socket of the ball holder by the compression spring.

The leakage of the ink due to the pumping effect (pressure reducing effect) of removing the evaporation-preventing cap from the barrel, and the suction of air due to the pumping effect (pressure increasing effect) of putting the cap on the barrel can be prevented.

When a ballpoint pen using a water-base ink is used with its axis tilted greatly from the vertical, the tip of the ball holder is always in frictional contact with the sheet and is abraded gradually and, eventually, the socket of the ball holder wears out and becomes unable to hold the ball, and the ball falls off. Since the compression spring exerts a fixed pressure continuously on the ball of the direct-feed ballpoint writing implement of the present invention so that the ball protrudes partly from the tip of the ball holder, the tip of the ball holder is not abraded and hence the ball does not fall off the ball holder.

Although the invention has been described in its preferred embodiment with a certain degree of particularity, obviously many changes and variations are possible therein. It is therefore to be understood that the present invention may be practiced otherwise than as specifically described herein without departing from the scope and spirit thereof.

What is claimed is:

1. A direct-feed ballpoint writing implement comprising:

a barrel internally provided with an ink tank; a grooved member placed in a front part of the barrel and provided with a groove for guiding air and ink; an ink feed member pressed in the grooved member;

a barrel tip fixedly joined to a front end part of the grooved member;

a ball holder inserted in the barrel tip and put on a front end part of the ink feed member; and a ball held in a front end part of the ball holder; wherein a compression spring is extended at least between the ink feed member and the ball in the ball holder;

wherein the ink feed member is provided in its front end with a recess, the compression coil spring has a squared back end, and the squared back end of the compression spring is fitted in the recess of the ink feed member.

2. A direct-feed ballpoint writing implement comprising:

a barrel internally provided with an ink tank;

a grooved member placed in a front part of the barrel and provided with a groove for guiding air and ink; an ink feed member pressed in the grooved member;

a barrel tip fixedly joined to a front end part of the grooved member;

a ball holder inserted in the barrel tip and put on a front end part of the ink feed member; and a ball held in a front end part of the ball holder;

wherein a compression spring is extended at least between the ink feed member and the ball in the ball holder; and wherein the compression spring has a back end part surrounding the ink feed member.

3. The direct-feed ballpoint writing implement according to claim 1, wherein the compression spring has a straight part axially extending from its front end toward the center of the ball.

* * * * *